US007644525B2

(12) United States Patent
Weber et al.

(10) Patent No.: US 7,644,525 B2
(45) Date of Patent: Jan. 12, 2010

(54) IRON COMPRISING A VALVE CONTROLLED BY A THERMALLY DEFORMABLE ELEMENT

(75) Inventors: Jochen Weber, Brombachtal (DE); Matthias Hahn, Frankfurt (DE)

(73) Assignee: Rowenta Werke GmbH, Offenbach (DE)

( * ) Notice: Subject to any disclaimer, the term of this patent is extended or adjusted under 35 U.S.C. 154(b) by 0 days.

(21) Appl. No.: 12/158,807

(22) PCT Filed: Dec. 6, 2006

(86) PCT No.: PCT/IB2006/003604

§ 371 (c)(1),
(2), (4) Date: Jun. 23, 2008

(87) PCT Pub. No.: WO2007/072145

PCT Pub. Date: Jun. 28, 2007

(65) Prior Publication Data

US 2009/0000161 A1 Jan. 1, 2009

(30) Foreign Application Priority Data

Dec. 22, 2005 (FR) ..... 05 13134

(51) Int. Cl.
*D06F 75/18* (2006.01)
*D06F 75/00* (2006.01)

(52) U.S. Cl. ..... 38/77.8

(58) Field of Classification Search ..... 38/74, 38/77.7, 77.8, 77.82, 82; 219/245, 251–253
See application file for complete search history.

(56) References Cited

U.S. PATENT DOCUMENTS

| | | | | |
|---|---|---|---|---|
| 3,188,757 | A | 6/1965 | Denton | |
| 4,125,953 | A | 11/1978 | Colombo | |
| 4,627,181 | A * | 12/1986 | Bastida | 38/77.7 |
| 4,656,763 | A * | 4/1987 | Kawasaki et al. | 38/77.83 |
| 4,780,973 | A * | 11/1988 | Vildosola | 38/77.7 |
| 4,882,968 | A * | 11/1989 | Yamada | 84/384 |
| 5,606,810 | A * | 3/1997 | Farrington et al. | 38/77.7 |
| 6,105,286 | A | 8/2000 | Ching et al. | |
| 6,167,643 | B1 * | 1/2001 | Dodier et al. | 38/77.8 |
| 6,318,009 | B1 | 11/2001 | De Maneville et al. | |

FOREIGN PATENT DOCUMENTS

| | | | |
|---|---|---|---|
| DE | 10225576 | A1 | 1/2004 |
| EP | 0674037 | A1 | 9/1995 |
| EP | 1000192 | B1 | 5/2000 |
| GB | 951532 | | 3/1964 |
| GB | 2170826 | A | 2/1986 |
| WO | 9200411 | A1 | 1/1992 |
| WO | 9809015 | A | 5/1998 |

* cited by examiner

*Primary Examiner*—Ismael Izaguirre
(74) *Attorney, Agent, or Firm*—Browdy and Neimark, PPLC

(57) ABSTRACT

Steam iron comprising a sole (1) in thermal communication with a heating body (5) equipped with a steam chamber (53), the steam chamber (53) communicating with a reservoir (7) by means of a supply circuit comprising a flow control valve (10) whose degree of opening is controlled by a thermally deformable element (16) in thermal communication with the heating body (5), characterized in that the opening of the control valve (10) is braked, beginning at an intermediate temperature, by a stabilizing element (18) that exerts a force that opposes the force generated by the thermally deformable element (16).

21 Claims, 7 Drawing Sheets

IRON COMPRISING A VALVE CONTROLLED BY A THERMALLY DEFORMABLE ELEMENT

The present invention relates to irons comprising a soleplate surmounted by a heating unit equipped with a steam chamber and more particularly relates to an iron in which the steam chamber communicates with a reservoir by means of a supply circuit comprising a control valve whose opening is controlled by a thermally deformable element in thermal communication with the heating unit.

There are steam irons known from the patents FR 2,358,498 and EP 1,000,192 comprising a water reservoir communicating with a steam chamber by means of a control valve whose opening is controlled by a bimetallic strip. Such irons offer the advantage of freeing the user from having to adjust the flow of steam, which is done automatically as a function of the temperature of the soleplate.

However, irons of this type have the disadvantage of having an automatic steam flow control device that is very sensitive to the relative positioning of the bimetallic strip with respect to the control valve, so that the adjustment of the steam obtained for a given temperature varies from one iron to another and depends, among other things, on the manufacturing tolerances and the assembly of the parts. In particular, the deformation range of a bimetallic strip for the operating temperatures of an iron is limited to approximately 3 mm, so the adjustment of the flow of steam is very sensitive to a deviation in the positioning of the bimetallic strip. Such irons therefore do not make it possible to obtain an optimized adjustment of the flow of steam for a given temperature of the soleplate, to the detriment of the ironing efficiency.

Thus, the object of the present invention is to eliminate these drawbacks by proposing an iron comprising an automatic steam flow control device that is less sensitive to manufacturing tolerances and to the assembly of the parts so as to ensure, from one iron to another, a more constant adjustment of the flow of steam for a given temperature of the soleplate.

Another object of the present invention is to propose an iron comprising an automatic steam flow control device having very good reactivity at low temperatures in order to prevent the water from being admitted into the steam chamber when the latter is too cold to evaporate the water, which runs the risk of dripping out through the steam outlet holes in the soleplate.

The object of the invention is achieved by a steam iron comprising a soleplate in thermal communication with a heating unit equipped with a steam chamber, the steam chamber communicating with a reservoir by means of a supply circuit comprising a flow control valve whose degree of opening is controlled by a thermally deformable element in thermal communication with the heating unit, characterized in that the opening of the control valve is braked, beginning at an intermediate temperature, by a stabilizing element exerting a force that opposes the force generated by the thermally deformable element.

Such a feature offers the advantage of making it possible to establish a plateau in the opening curve of the control valve as a function of the temperature. The degree of opening of the valve is thus stabilized, in a temperature range of several degrees beginning at the intermediate temperature, at a value that allows the flow of steam to be adapted to the intermediate temperature of the soleplate. Moreover, the fact that the stabilizing element does not affect the opening of the valve below the intermediate temperature makes it possible to retain high reactivity at the low operating temperatures of the iron, thus making it possible to ensure an efficient anti-drip function.

According to another feature of the invention, the intermediate temperature at which the thermally deformable element begins to be braked by the stabilizing element is between 130° C. and 150° C.

According to another feature of the invention, the stabilizing element is constituted by a spring rod.

According to another feature of the invention, the force produced by the stabilizing element is exerted directly on a component of the control valve.

According to another feature of the invention, the force produced by the stabilizing element is exerted directly on the thermally deformable element.

According to yet another feature of the invention, the stabilizing element and the control valve are borne by the same support piece.

According to another feature of the invention, the support piece is a thermal shield disposed on top of the heating unit.

According to another feature of the invention, the thermally deformable element is a bimetallic strip.

According to yet another feature of the invention, the supply circuit also comprises a plug valve disposed in series with the control valve, which plug valve can occupy a closed position for dry ironing and at least one open position calibrated to allow the passage of a flow of water corresponding to the maximum steam rate that the steam chamber can provide.

According to another feature of the invention, the plug valve can occupy an additional position that allows a larger quantity of water to pass through abruptly in order to perform a self-cleaning operation.

The objects, aspects and advantages of the present invention will be more clearly understood by referring to the following description of a particular embodiment of the invention given as a nonlimiting example, in reference to the attached drawings, in which.

Figure 10:
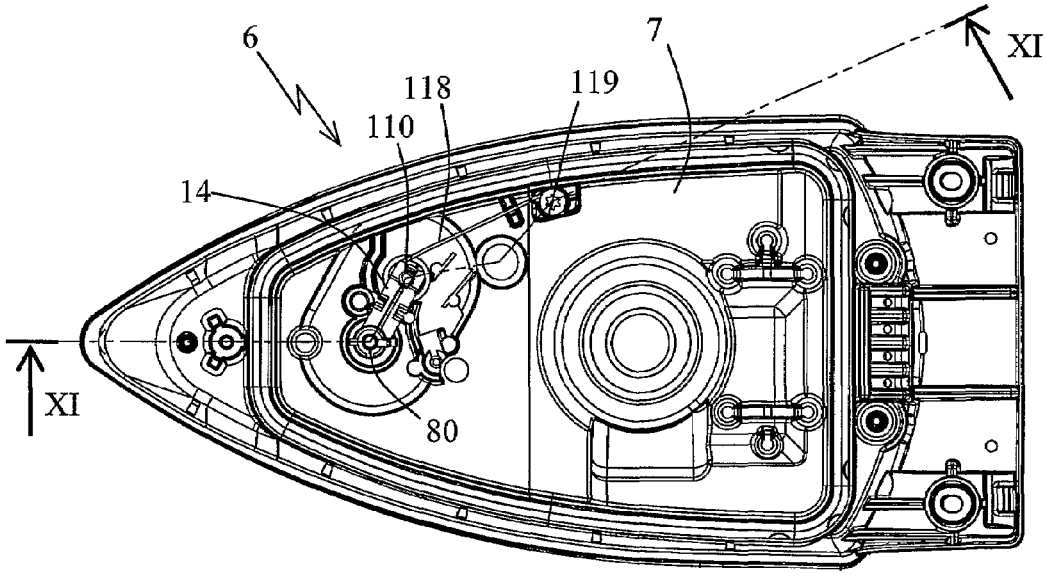
FIG. 10 is a top view of the thermal shield of the iron of FIG. 1 equipped with a control device according to a second embodiment of the invention.
Figure 12:
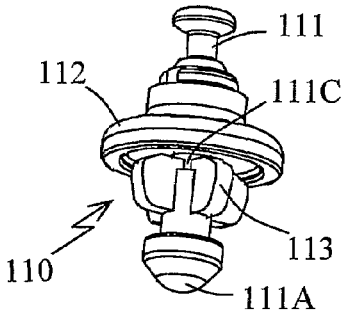
Figure 13A:
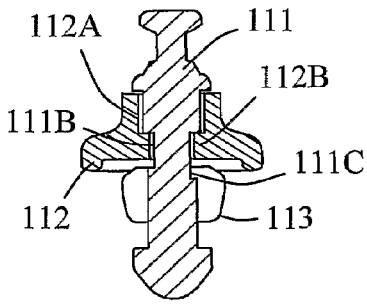
Figure 13B:
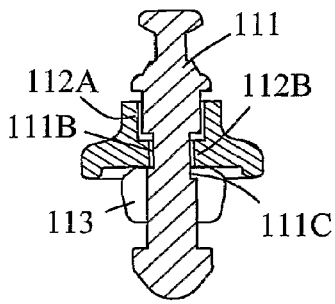
Figure 14:
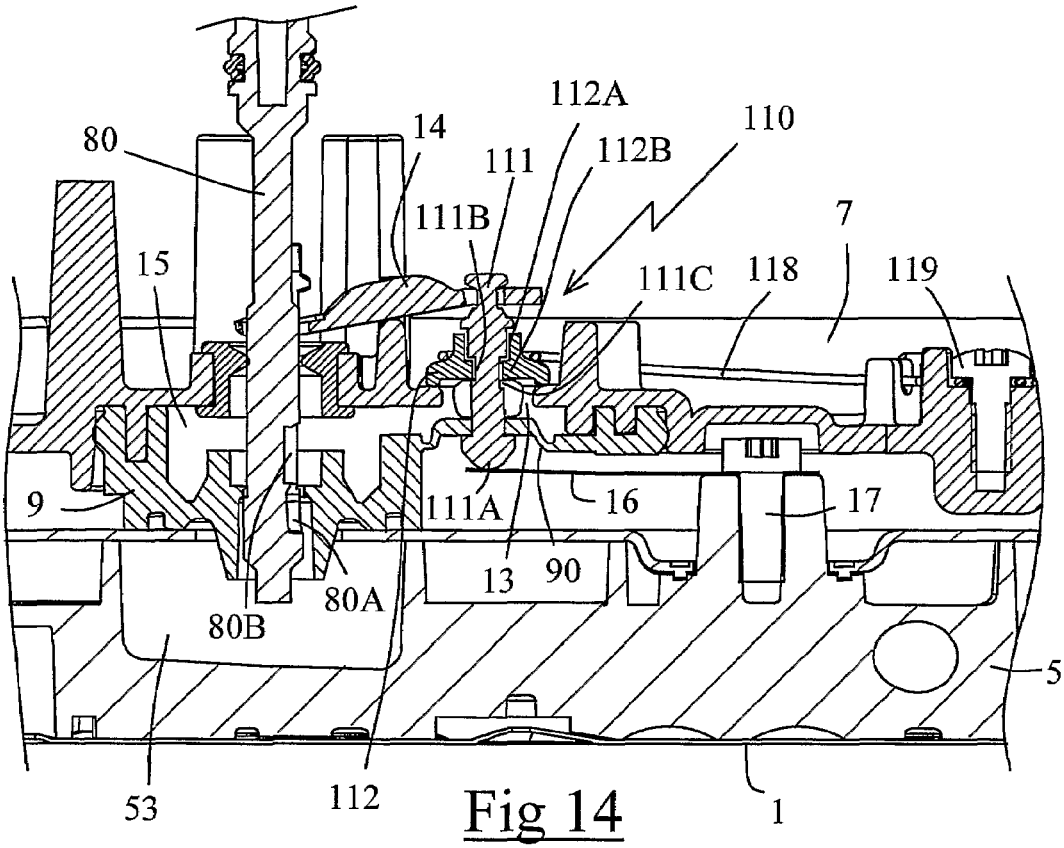
Figure 15:
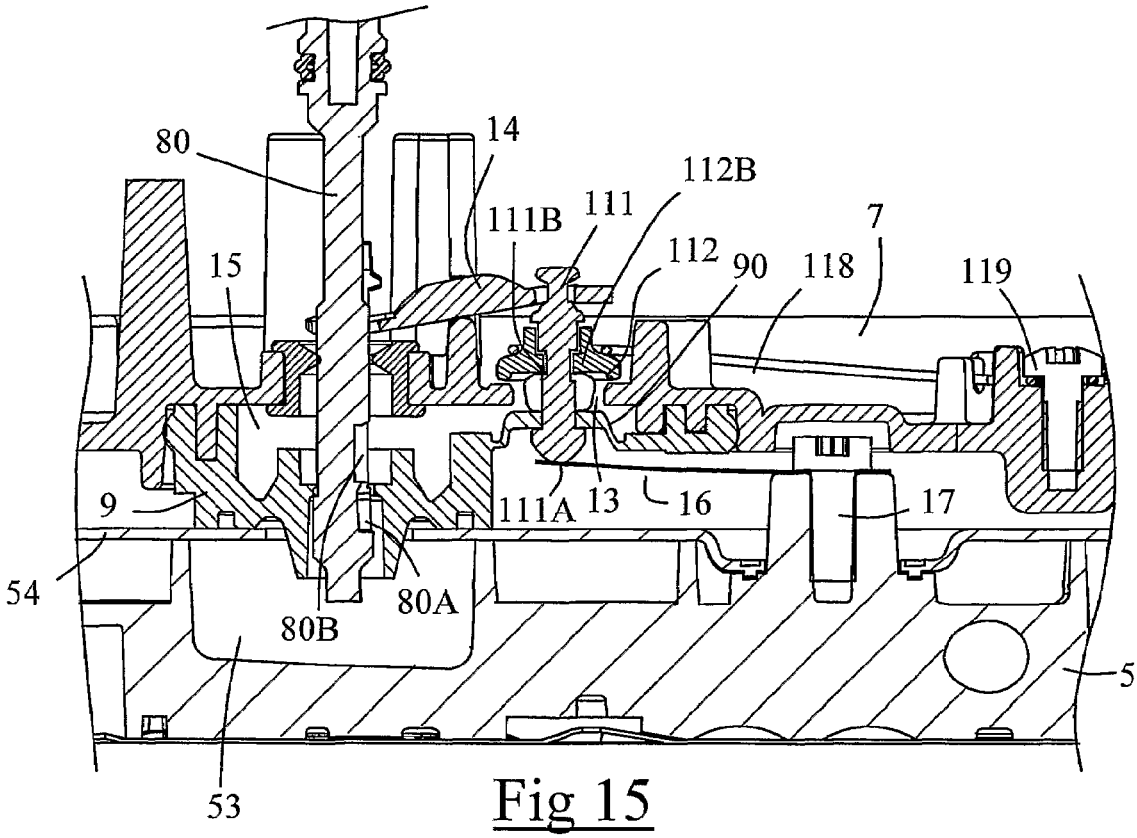

FIGS. 12, 13*a* and 13*b* are, respectively, a perspective view and sectional views in the closed and open positions of the valve of the control device according to the second embodiment of the invention;

FIGS. 14 and 15 are enlarged partial sectional views along line XI-XI of FIG. 10 when the temperature of the heating unit is respectively below and above a temperature threshold, the plug valve being shown in the open position.

Only the elements required for an understanding of the invention have been represented. To facilitate the reading of the drawings, the same elements have the same references from one figure to another.

Figure 1:
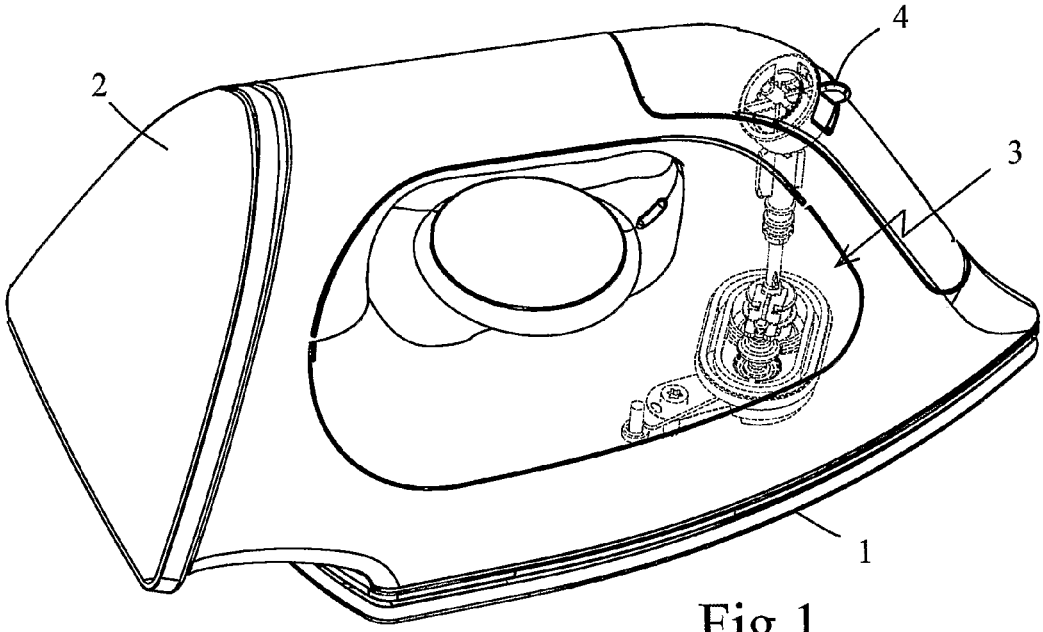
FIG. 1 is a perspective view of a steam iron according to a particular embodiment of the invention, seen from above.
Figure 5:
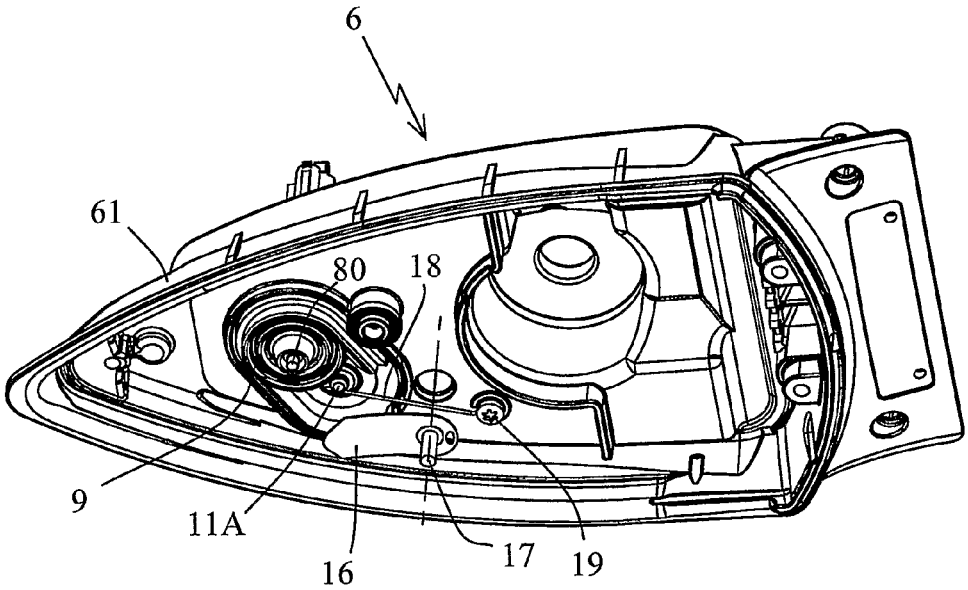
FIG. 5 is a perspective view, seen from above, of the thermal shield and the steam control device with which the iron of FIG. 2 is equipped.

FIG. 1 represents a steam iron comprising a soleplate 1 surmounted by a housing 2 enclosing a steam control device 3, represented by dotted lines in this figure, comprising a control button 4 accessible on the front of the iron.

Figure 2:
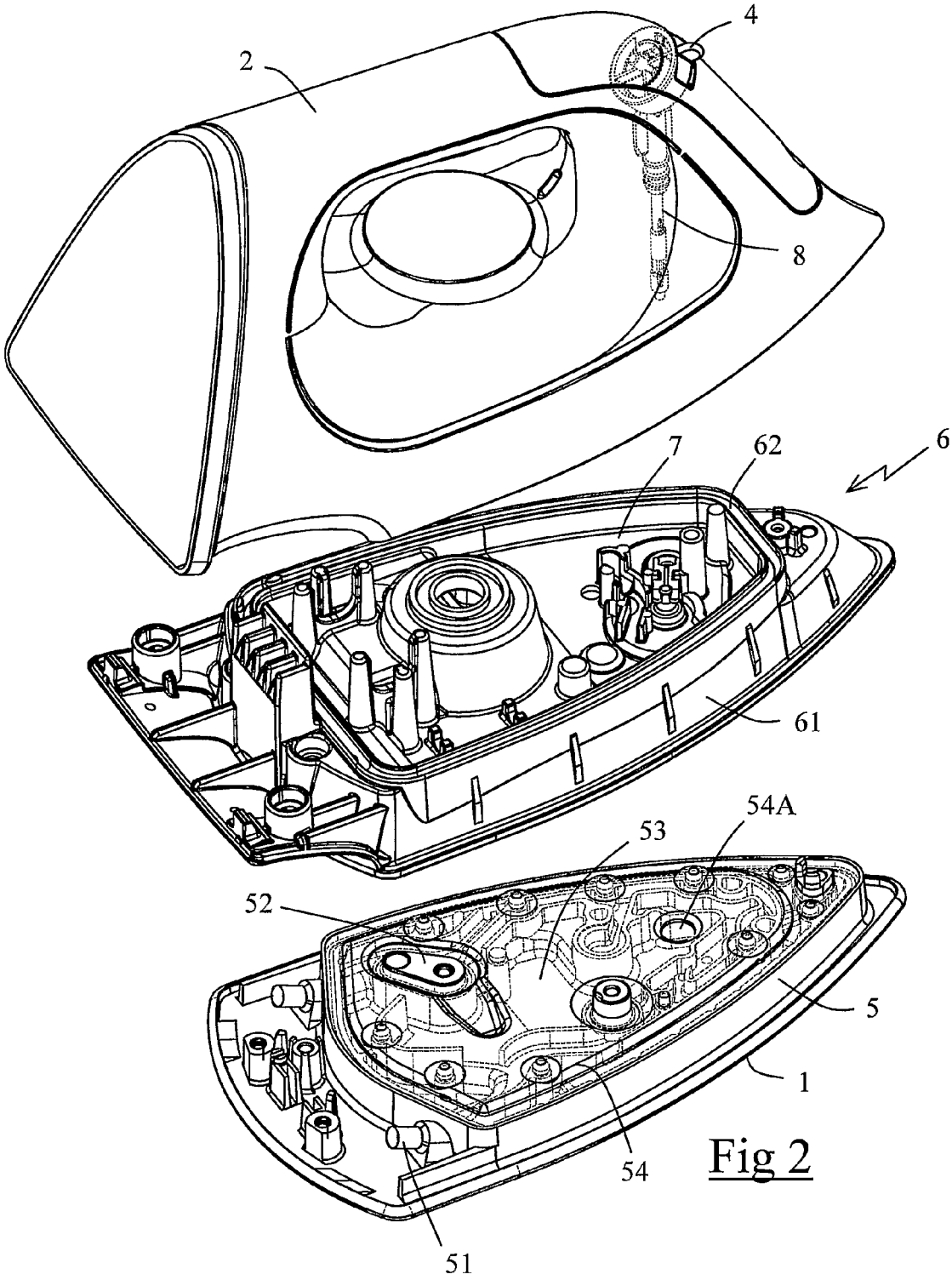
FIG. 2 is an exploded perspective view of the iron of FIG. 1.
Figure 3:
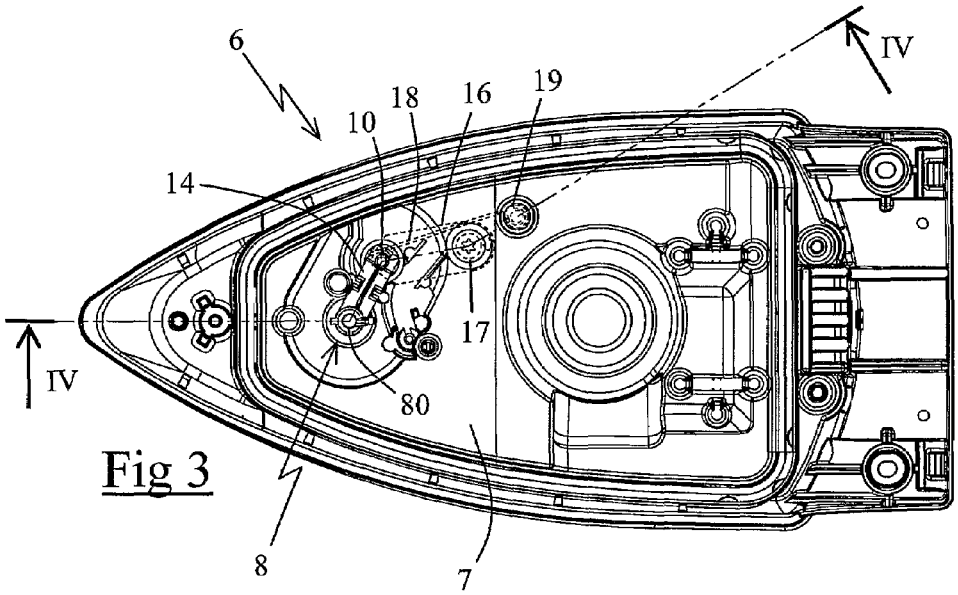
FIG. 3 is a top view of the thermal shield and the steam control device of the iron of FIG. 2.
Figure 4:
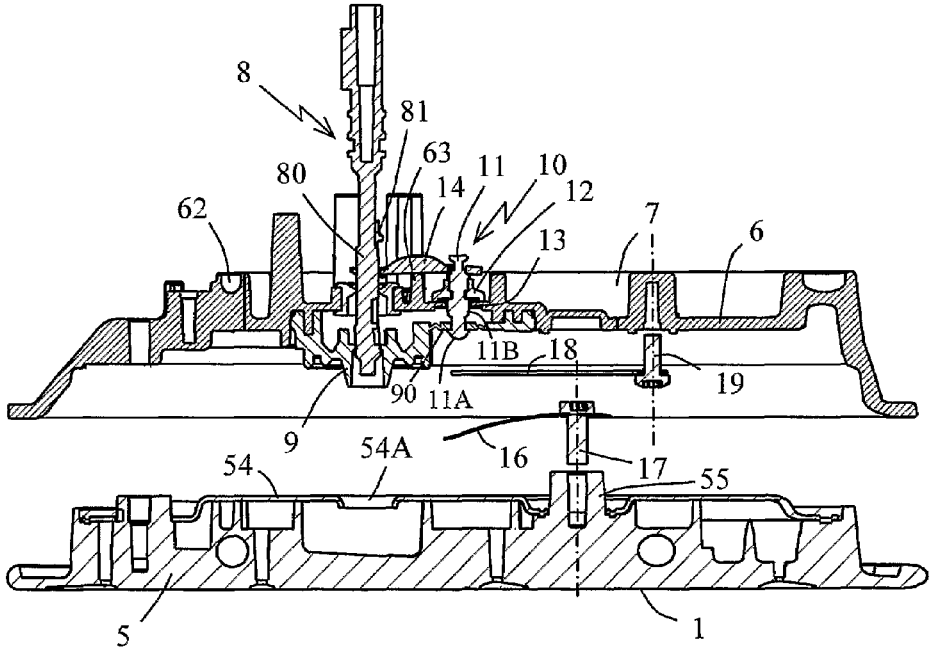
FIG. 4 is an exploded sectional view of the heating unit, the thermal shield and the steam control device of the iron along line IV-IV of FIG. 3.

According to FIG. 2, the soleplate 1 is surmounted by a heating unit 5, advantageously made of aluminum, conventionally comprising a heating element 51 bent into a horseshoe shape and a boss 52 provided for receiving a temperature control thermostat, not shown in the figures.

The heating unit 5 comprises, in its upper part, a steam chamber 53 of large dimensions, shown in dotted lines in FIG. 2, closed by a closing plate 54 having an opening 54A near the front end of the steam chamber 53.

A thermal shield 6 is interposed between the top face of the heating unit 5 and the housing 2, this thermal shield 6 incorporating a lateral skirt 61 having a lower edge that conforms to the external shape of the soleplate 1.

The housing 2 encloses a water reservoir 7 whose bottom part is defined by the thermal shield 6, the latter comprising an annular channel 62 that receives, with an interposed sealing strip, the walls of the housing 2 defining the top part of the reservoir.

According to FIGS. 3 through 6, the iron comprises a supply circuit that provides a passage for the water from the reservoir 7 to the steam chamber 53 and comprises a plug valve 8 that extends into the opening 54A of the plate 54, the plug valve 8 comprising a nozzle gasket 9 that rests on the closing plate 54 and a stem 80 whose axial movement is controlled by the control button 4.

By means of the control button 4, the stem 80 of the plug valve can be brought into three distinct positions, respectively for dry-ironing, for steam-ironing and for a self-cleaning operation for de-scaling the iron.

Figure 6:
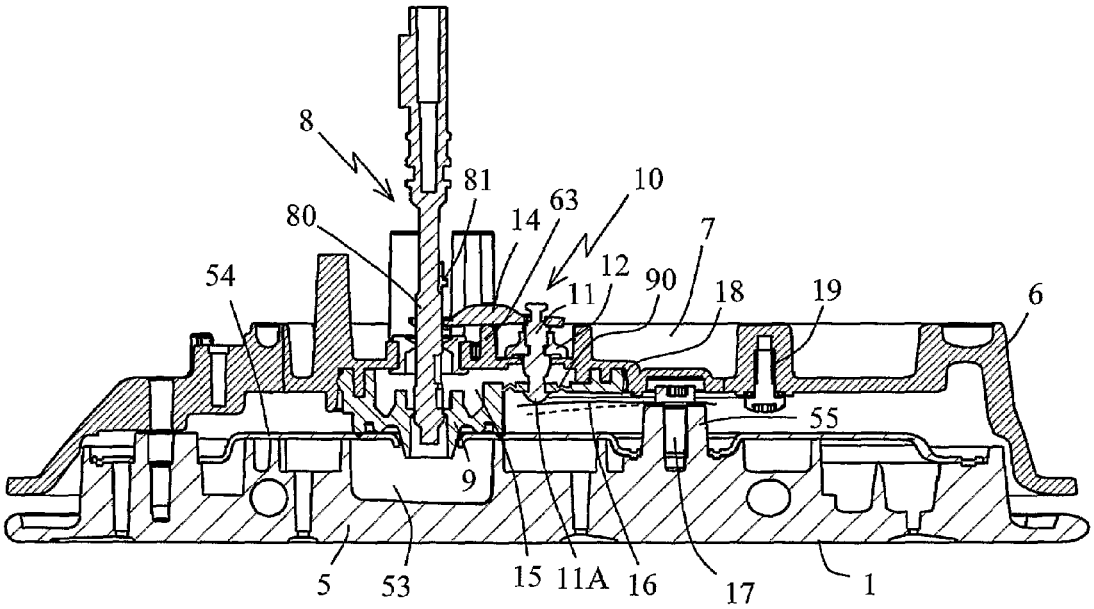
FIG. 6 is a similar sectional view along line IV-IV of FIG. 3 when the temperature of the heating unit is at a temperature that is just high enough to cause the evaporation of the water, the plug valve being shown in the closed position.

To this end, the stem 80 comprises a solid part that closes the opening of the nozzle gasket 9 when the stem 80 is moved into the position illustrated in FIG. 6.

Figure 7:
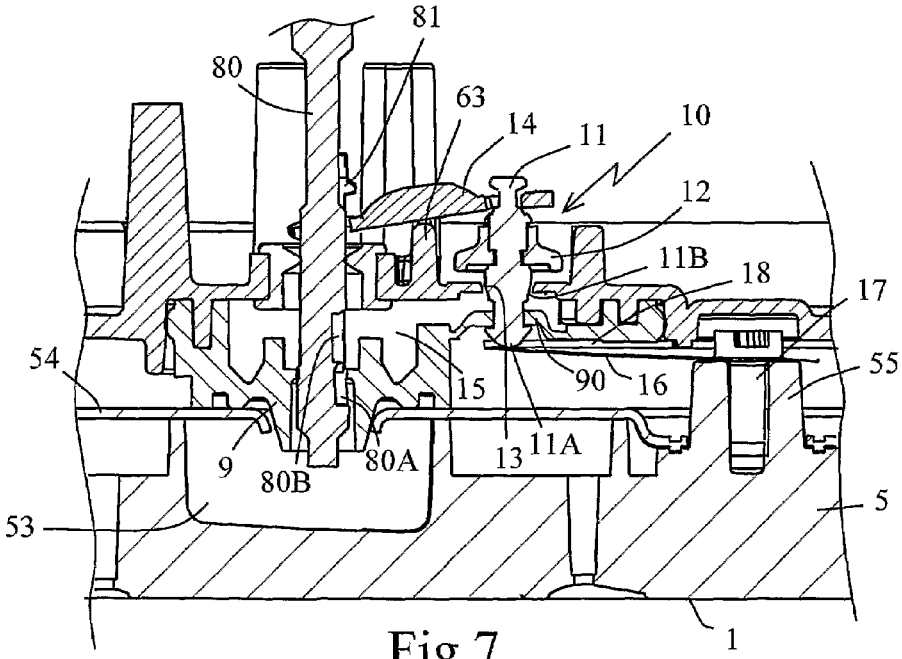
FIGS. 7 and 8 are enlarged partial sectional views along line IV-IV of FIG. 3 when the temperature of the heating unit is respectively below and above a temperature threshold, the plug valve being shown in the open position.
Figure 8:
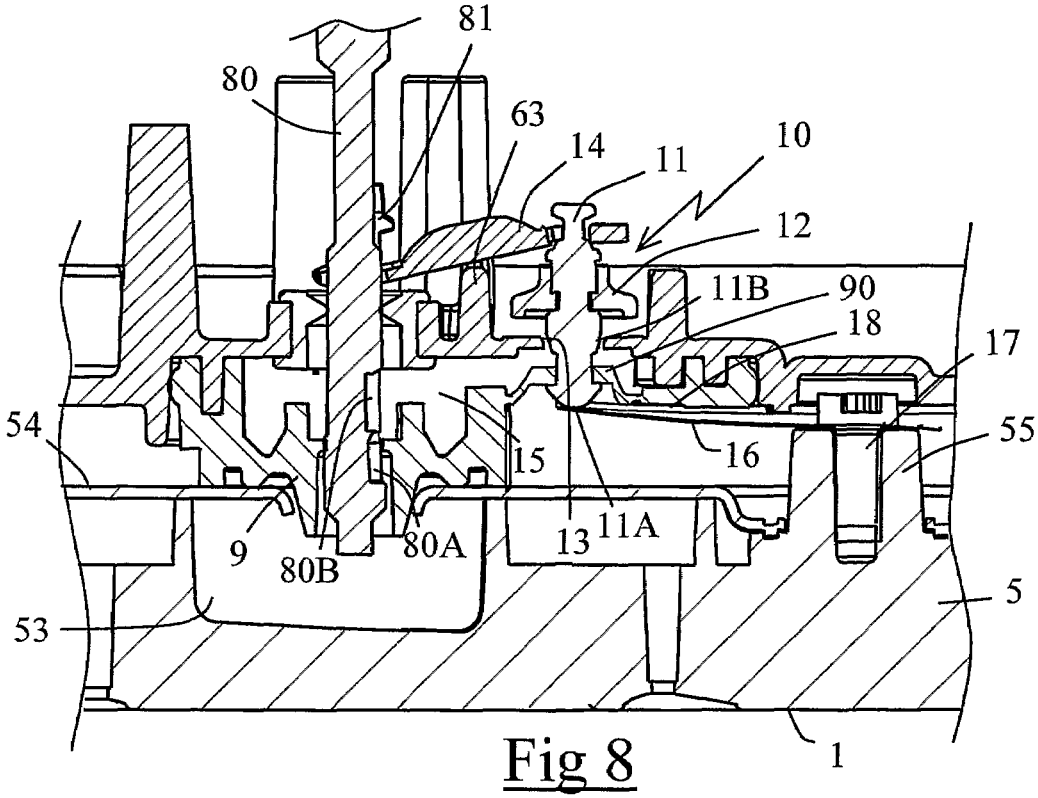

The stem 80 also comprises a first notch 80A having a flow cross-section that limits the maximum flow of water sent to the steam chamber 53 when the stem 80 of the plug valve is moved into the position illustrated in FIGS. 7 and 8 by rotating the control button 4.

Figure 9:
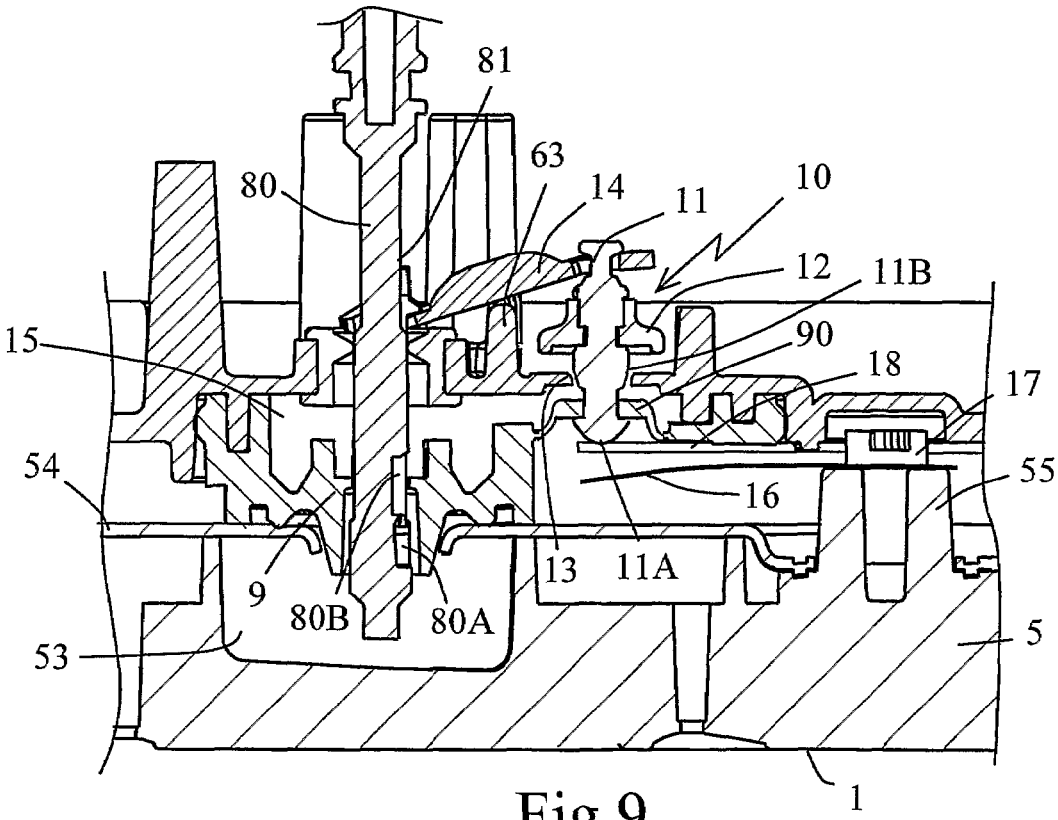
FIG. 9 is a view similar to FIGS. 7 and 8 when the user operates the self-cleaning button.

Lastly, the stem 80 of the plug valve comprises a second notch 80B that provides a larger flow cross-section and allows the iron to be cleaned by the abrupt delivery of a large quantity of water into the superheated steam chamber 53 when the stem 80 is moved into the position illustrated in FIG. 9 by rotating the control button 4.

The supply circuit comprises, upstream from the plug valve 8, a control valve 10 and an intermediate chamber 15 disposed between the control valve 10 and the plug valve 8.

The control valve 10 comprises a shaft 11 equipped with a conical part 11B that extends through an opening 13 that opens into the bottom of the reservoir 7 so that the flow cross-section of the water from the reservoir to the intermediate chamber varies when the shaft 11 is moved axially through the opening 13. The top part of the shaft 11 supports a closing element 12 constituted by a rubber bell that surrounds the shaft 11, the periphery of the cap 12 coming into watertight contact with the perimeter of the opening 13 when the shaft 11 is moved axially downward, as illustrated in FIG. 6.

The top end of the shaft 11 is connected to the end of a lever 14 pivot-mounted on a wall 63 borne by the thermal shield 6, the other end of the lever 14 having an opening through which the stem 80 of the plug valve passes, the latter comprising a pin 81 that comes to rest on the end of the lever 14 when the control button 4 is moved into the self-cleaning position.

The bottom part of the shaft 11 passes through a sealing diaphragm 90 and has a rounded end forming a tip 11A that is aligned with the free end of an elongated bimetallic strip 16 borne by the heating unit 5, the bimetallic strip 16 being attached to a boss 55 of the heating unit 5 by means of a screw 17. Advantageously, the sealing diaphragm 90 is borne by the rubber piece attached to the thermal shield 6 that also defines the nozzle gasket 9, this rubber piece delimiting the bottom part of the intermediate chamber 15.

More particularly according to the invention, the control valve 10 comprises a stabilizing element constituted by a spring rod 18 borne by the thermal shield 6. This spring rod 18 is advantageously attached at one of its ends to the bottom face of the thermal shield 6 by means of a screw 19, the other end of the spring rod 18 extending freely over the bimetallic strip 16 and coming to abut the tip 11A of the control valve, as is clearly visible in FIG. 5. For example, the spring rod 18 will be made of stainless steel wire with a diameter on the order of 0.8 to 1 mm.

The operation of the control device will now be described in connection with FIGS. 6 through 9.

FIG. 6 represents a sectional view of the supply circuit of the steam chamber 53 in which dot-and-dash lines represent the position of the bimetallic strip 16 for a cold soleplate and solid lines represent the position of the bimetallic strip for a soleplate temperature on the order of 120° C. In this figure, the stem 80 of the plug valve 8 is shown, by way of example, in the closed position for dry ironing.

According to this figure, when the temperature of the soleplate is lower than 120° C., the bimetallic strip 16 is curved downward and is not in contact with the tip 11A on the end of the stem of the control valve 10, the weight of the shaft 11 and the elasticity of the diaphragm 90 ensuring the closing of the closing element 12. Under these conditions, the water from the reservoir 7 cannot flow into the intermediate chamber 15, so the steam chamber 53 does not receive any water, even if the plug valve 8 is in the open position, as illustrated for example in FIG. 7, for steam ironing.

The bimetallic strip 16 thus provides an anti-drip function by preventing water from being sent into the steam chamber 53 when the temperature of the latter is not high enough to ensure its evaporation.

When the temperature of the soleplate 1 reaches a temperature on the order of 120° C., the bimetallic strip 16 again comes into contact with the tip 11A on the end of the shaft of the control valve 10, then acts on the latter with a vertical pressure that tends to lift the shaft 11 and the closing element 12 associated with it. Above that temperature, the pressure exerted on the bimetallic strip 16 lifts the closing element 12 and the water from the reservoir 7 can flow at a low rate through the opening 13 into the intermediate chamber 15.

When the temperature of the soleplate reaches an intermediate temperature, around 140° C., the bimetallic strip comes into contact with the spring rod 18, as illustrated in FIG. 7, which represents an enlarged view of the supply circuit. The bimetallic strip 16 is thus stabilized in a predefined position by the spring rod 18, this stabilized position of the bimetallic strip 16 corresponding to an opening of the valve 10 adapted for supplying a low flow of steam, for example on the order of 10 g/min, the shaft 11 then being lifted by approximately 0.5 mm relative to its initial resting position corresponding to the closure of the closing element 12.

Beginning at this intermediate temperature, the deformation of the bimetallic strip 16 is braked by the forces generated by the spring rod 18 so that an additional lifting of the shaft 11 only occurs if the force generated by the bimetallic strip 16 is greater than the force generated by the spring rod 18. This additional lifting advantageously occurs beginning at 160° C. and the movement of the shaft 11 of the control valve 10, braked by the spring rod 18, is then substantially linear with the increase in the temperature until the maximum opening of the valve 10 is reached, as shown in FIG. 8, which corresponds to a temperature of the soleplate on the order of 200° C.

Thus, between the temperature on the order of 160° C. at which the force generated by the bimetallic strip 16 is greater than the force generated by the spring rod 18 and the maximum ironing temperature of the soleplate, a controlled movement of the shaft 11 of the control valve 10 is obtained, resulting in a progressive increase in the flow of water running into the steam chamber 53, which is defined by the flow cross-section at the level of the conical part 11B of the shaft passing through the opening 13.

Advantageously, the flow of water that can be sent into the steam chamber 53 is limited to a maximum value defined by the flow cross-section of the first notch 80A of the stem of the plug valve, this first notch 80A being dimensioned to correspond to the maximum flow of steam that can be produced by the steam chamber 53, given the power of the heating element 51. For example, the first groove 80A will be dimensioned so as to allow a maximum flow of water corresponding to a steam production on the order of 35 g/min.

FIG. 9 illustrates the supply circuit of the steam chamber 53 when the control button 4 is turned to the self-cleaning position. In this position of the button 4, the stem 80 of the plug valve is moved downward and the second notch 80B, of larger cross-section, is aligned with the nozzle gasket 9, thus allowing the abrupt delivery of a large quantity of water into the steam chamber 53. This self-cleaning operation, which is intrinsically known, takes place with the temperature thermostat of the soleplate 1 set to the maximum temperature. According to this figure, the downward movement of the stem 80 is accompanied by a push from the pin 81 on the end of the lever 14, which causes the latter to pivot, the opposite end of the lever maintaining the shaft 11 of the control valve 10 in a raised position corresponding to the maximum degree of opening of the valve 10. Such a feature makes it possible to maintain a large flow of water from the reservoir 7 to the steam chamber 53 when the temperature of the soleplate drops during the self-cleaning operation.

FIGS. 10 through 15 illustrate a variant of embodiment of the supply circuit of the steam chamber wherein the control valve and the stabilizing element constituted by the spring rod have been modified, the other elements of the iron remaining being similar to those described above for the first embodiment of the invention.

According to these figures, the supply circuit comprises a control valve 110 comprising a substantially cylindrical shaft 111 extending through the opening 13 in the bottom of the reservoir, this shaft 111 supporting a closing element 112 constituted by a rubber bell capable of sealing the opening 13 when the shaft 111 is moved downward.

More particularly according to the invention, the control valve 110 comprises a stabilizing element constituted by a spring rod 118 borne by the thermal shield 6. This spring rod 118 has one of its ends attached to the top face of the thermal shield 6 by means of a screw 119, the other end of the spring rod 118 having a bent portion that extends over the closing element 112 and exerts a downward pressure on the latter in order to close the closing element 112 and prevent the flow of water from the reservoir 7 to the opening 13.

In a way that is similar to the first embodiment, the top end of the shaft 111 is connected to the lever 14 pivot-mounted to the wall 63 and the bottom end of the shaft 111 has a rounded end forming a tip 111A that passes through the sealing diaphragm 90 and aligns with the free end of the bimetallic strip 16 borne by the heating unit 5.

More particularly according to this variant of embodiment, the shaft 111 of the valve 110 has four vanes 113 extending 90° from one another between the closing element 112 and the diaphragm 90, these vanes forming spacers which participate, in particular, in the immobilization of the diaphragm 90 on the shaft 111.

As may be seen more clearly in FIGS. 13*a* and 13*b*, the closing element 112 has a center bore 112A comprising in its bottom part a reduced diameter forming a lip 112B that fits into a groove 111B of the shaft 111 disposed just above the vanes 113. The diameters of the center bore 112A and the lip 112B are larger than the external diameters of the parts of the shaft 111 that align with them, resulting in a radial space between the shaft 111 and the closing element 112, advantageously on the order of several tens of millimeters, which allows the water to pass through.

The height of the groove 111B is greater than the height of the lip 112B so that the shaft 111 can move axially by several millimeters through the closing element 112 between a closed position, shown in FIG. 13*a*, in which the lip 112B rests against the top edge of the groove 111B, and an open position, shown in FIG. 13*b*, in which the lip 112B rests against the bottom edge of the groove 111B. In the closed position, the water from the reservoir 7 cannot flow to the intermediate chamber 15 because of the watertight seal established between the top edge of the lip 112B and the top edge of the groove 111B. Conversely, in the open position, the water from the reservoir can pass into the radial space running between the shaft 111 and the lip 112B and flow through a calibrated notch 111C formed in the bottom edge of the groove 111B, between two vanes 113.

The operation of the control device according to the second embodiment will now be described in connection with FIGS. 11, 14 and 15.

Figure 11:
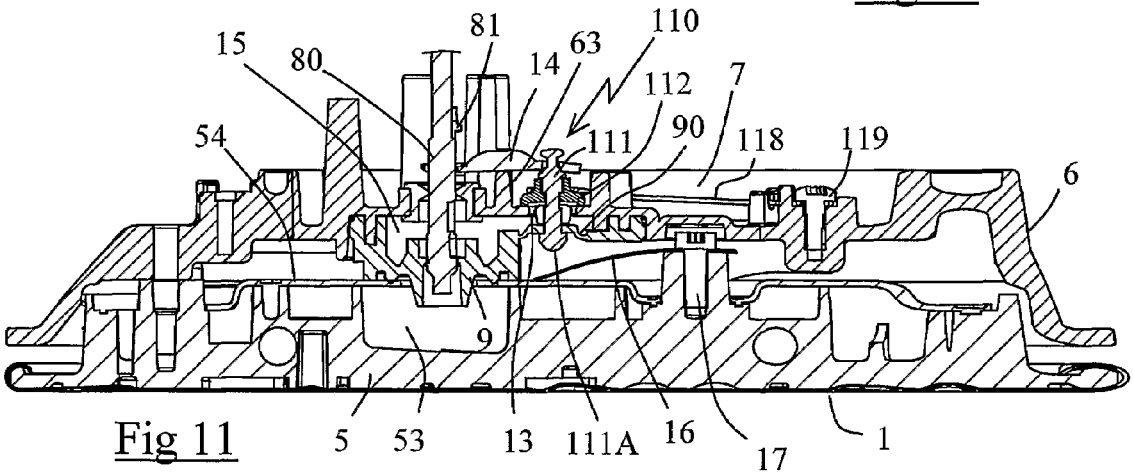
FIG. 11 is a sectional view along line XI-XI of FIG. 10, when the temperature of the soleplate is cold, the plug valve being shown in the closed position.

FIG. 11 illustrates the supply circuit of the steam chamber 53 when the temperature of the soleplate 1 is cold, the bimetallic strip 16 being curved downward and the closing element 112 of the control valve 110 being returned by the spring rod 118 in contact with the wall of the thermal shield 6 defining the bottom of the reservoir. In this position, the closing element 112 forms a watertight seal around the opening 13 and the shaft 111 of the control valve is moved, by its weight and by the elastic return of the sealing diaphragm 90, into the position illustrated in FIG. 13*b* in which the top edge of the lip 112B of the closing element is in watertight contact with the top edge of the groove 111B so that the water cannot flow into the steam chamber 53.

As the temperature of the soleplate 1 increases, the bimetallic strip 16 enters into contact with the tip 11A of the shaft of the control valve and lifts the latter slightly so as to bring the bottom edge of the groove 111B into contact with the bottom edge of the lip 112B, as illustrated in FIGS. 13*b* and 14, when the temperature of the soleplate reaches an intermediate temperature, advantageously on the order of 140° C.

According to FIG. 14, this lifting of the shaft 111 of the control valve first takes place without lifting the closing element 112, which remains pressed against the bottom of the reservoir 7, thus ensuring the seal around the opening 13. In fact, preferably, the force generated by the spring rod 118 on the closing element 112 is greater than the force generated by the bimetallic strip 16 on the shaft 111 when the temperature of the soleplate 1 remains below a temperature threshold, advantageously on the order of 160° C. In this position of the control valve 110, the water can pass into the space running between the center bore 112A, the lip 112B of the closing element and the shaft 111 of the valve, then escape in the direction of the intermediate chamber 15 through the notch 111C provided on the perimeter of the bottom edge of the groove 111B prior to flowing through the plug valve 8 into the steam chamber 53. Thus, for a temperature of the soleplate between 140° C. and 160° C., a substantially constant flow of water is obtained which is defined by the flow cross-section of the notch 111C, the latter being adapted for producing a flow of steam on the order of 10 g/min.

When the temperature of the soleplate reaches the temperature thresholds on the order of 160° C., the force exerted by the bimetallic strip 16 on the tip 111A of the shaft is greater than the force exerted by the spring rod 118 on the closing element 112 so that the closing element 112 is lifted off the bottom of the reservoir 7, as illustrated in FIG. 15. In this position, the control valve 110 allows a large quantity of water to pass under the closing element 112, then through the opening 13 to the intermediate chamber 15, the flow of water sent to the steam chamber 53 being limited by the flow cross-section of the first notch 80A of the stem of the plug valve, which is dimensioned to allow the passage of a maximum flow of water corresponding to a steam production of 35 g/min.

This results in a steam iron equipped with a device for automatically controlling the steam as a function of the temperature of the soleplate wherein the opening of the valve for controlling the flow of water sent to the steam chamber at around an intermediate temperature, is stabilized at a predetermined value by the spring rod so that the opening of the valve is substantially constant in a temperature range of about ten degrees above that intermediate temperature. Such a control device thus makes it possible to considerably reduce the impact of the tolerances for the assembly of the thermal shield to the heating unit on the adjustment of the control device. Moreover, the fact that the spring rod is directly attached to the thermal shield makes it possible to reduce any imprecision due to variances in assembly, given that the control valve and the spring rod are borne by the same part.

Conversely, the free deformation of the bimetallic strip relative to the temperature below the reference temperature makes it possible to maintain a system that is highly reactive at low temperatures so that the system efficiently ensures the anti-drip function by ensuring the rapid blockage of the flow of water to the steam chamber when the latter is not at a high enough temperature to ensure the evaporation of the drops of water.

It is understood that the invention is in no way limited to the embodiment described and illustrated, which is given only as an example. Certain modifications are possible, particularly from the standpoint of the arrangement of the various elements or the substitution of technical equivalents, without going beyond the scope of protection of the invention.

Thus, in a variant of embodiment not represented, the bimetallic strip can, for example, take the form of a disk or a thermostatic spring.

Thus, in another variant of embodiment not represented, the control valve can be a rotary valve.

The invention claimed is:

1. Steam iron comprising a soleplate (1) in thermal communication with a heating unit (5) equipped with a steam chamber (53), the steam chamber (53) communicating with a reservoir (7) by means of a supply circuit comprising a flow control valve (10; 110) whose degree of opening is controlled by a thermally deformable element (16) in thermal communication with the heating unit (5), characterized in that the opening of the control valve (10; 110) is braked, only beginning at an intermediate temperature, by a stabilizing element (18; 118) exerting a force that opposes the force generated by the thermally deformable element (16).

2. Iron according to claim 1, characterized in that the intermediate temperature at which the thermally deformable element (16) begins to be braked by the stabilizing element (18; 118) is between 130° C. and 150° C.

3. Iron according to claim 1, characterized in that said stabilizing element (18; 118) is constituted by a spring rod.

4. Iron according to claim 3, characterized in that the force produced by the stabilizing element (118) is exerted directly on a component (112) of the control valve (110).

5. Iron according to claim 3, characterized in that the force produced by the stabilizing element (18) is exerted directly on the thermally deformable element (16).

6. Iron according to claim 1, characterized in that the force produced by the stabilizing element (118) is exerted directly on a component (112) of the control valve (110).

7. Iron according to claim 6, characterized in that said iron further comprises a support piece (6) bearing said stabilizing element (18; 118) and the control valve (10; 110).

8. Iron according to claim 7, characterized in that said support piece (6) is a thermal shield disposed on top of the heating unit (5).

9. Iron according to claim 8, characterized in that said thermally deformable element (16) is a bimetallic strip.

10. Iron according to claim 9, characterized in that the supply circuit also comprises a plug valve (8) disposed in series with said control valve (10; 110), said plug valve (8) being able to occupy a closed position for dry ironing and at least one open position calibrated to allow the passage of a flow of water corresponding to the maximum steam rate that the steam chamber (53) can provide.

11. Iron according to claim 1, characterized in that the force produced by the stabilizing element (18) is exerted directly on the thermally deformable element (16).

12. Iron according to claim 11, characterized in that said iron further comprises a support piece (6) bearing said stabilizing element (18; 118) and the control valve (10; 110).

13. Iron according to claim 12, characterized in that said support piece (6) is a thermal shield disposed on top of the heating unit (5).

14. Iron according to claim 13, characterized in that said thermally deformable element (16) is a bimetallic strip.

15. Iron according to claim 14, characterized in that the supply circuit also comprises a plug valve (8) disposed in series with said control valve (10; 110), said plug valve (8) being able to occupy a closed position for dry ironing and at least one open position calibrated to allow the passage of a flow of water corresponding to the maximum steam rate that the steam chamber (53) can provide.

16. Iron according to claim 1, characterized in that said iron further comprises a support piece (6) bearing said stabilizing element (18; 118) and the control valve (10; 110).

17. Iron according to claim 16, characterized in that said support piece (6) is a thermal shield disposed on top of the heating unit (5).

18. Iron according to claim 1, characterized in that said thermally deformable element (16) is a bimetallic strip.

19. Iron according to claim 1, characterized in that the supply circuit also comprises a plug valve (8) disposed in series with said control valve (10; 110), said plug valve (8) being able to occupy a closed position for dry ironing and at least one open position calibrated to allow the passage of a flow of water corresponding to the maximum steam rate that the steam chamber (53) can provide.

20. Iron according to claim 19, characterized in that said plug valve (8) can occupy an additional position that allows a larger quantity of water to pass through abruptly in order to perform a self-cleaning operation.

21. Steam iron comprising: a soleplate in thermal communication with a heating unit equipped with a steam chamber, and a supply circuit connected between said reservoir and said steam chamber for supplying water from said reservoir to said steam chamber, wherein:

said supply circuit comprises a flow control valve and a thermally deformable element in thermal communication with the heating unit, said thermally deformable element being operative to generate a force to cause said flow control valve to open, starting from a first temperature, by an amount controlled by said thermally deformable element; and said iron further comprises a stabilizing element operative to brake movement of said control valve over an intermediate temperature range that is spaced from the first temperature, by exerting a force that opposes the force generated by said thermally deformable element.

* * * * *